US008678613B2

(12) United States Patent
Pickard et al.

(10) Patent No.: US 8,678,613 B2
(45) Date of Patent: Mar. 25, 2014

(54) LOW THERMAL LOAD, HIGH LUMINOUS SOLID STATE LIGHTING DEVICE

(75) Inventors: Paul Kenneth Pickard, Morrisville, NC (US); Nicholas W. Medendorp, Jr., Raleigh, NC (US); Michael James Harris, Cary, NC (US); James Michael Lay, Cary, NC (US)

(73) Assignee: Cree, Inc., Durham, NC (US)

( * ) Notice: Subject to any disclaimer, the term of this patent is extended or adjusted under 35 U.S.C. 154(b) by 115 days.

(21) Appl. No.: 13/276,681

(22) Filed: Oct. 19, 2011

(65) Prior Publication Data

US 2013/0100658 A1 Apr. 25, 2013

(51) Int. Cl.
*F21V 29/00* (2006.01)
*F21V 21/00* (2006.01)

(52) U.S. Cl.
USPC ..... 362/230; 362/235; 362/249.02

(58) Field of Classification Search
CPC ..... F21V 29/00; F21V 21/00; F21K 9/00
USPC ..... 362/230, 249.01, 235, 227, 237, 362/293.545, 800; 313/45–46, 498–512; 315/32, 112; 445/23
See application file for complete search history.

(56) References Cited

U.S. PATENT DOCUMENTS

| | | | |
|---|---|---|---|
| 7,862,214 | B2 | 1/2011 | Trott et al. |
| 2010/0085759 | A1 | 4/2010 | O'Sullivan et al. |
| 2010/0110699 | A1 | 5/2010 | Chou |
| 2010/0177509 | A1 | 7/2010 | Pickard |
| 2011/0050070 | A1 | 3/2011 | Pickard |
| 2011/0051418 | A1 | 3/2011 | Sibalich |
| 2011/0074265 | A1 | 3/2011 | Van De Ven et al. |
| 2011/0089830 | A1 | 4/2011 | Pickard et al. |
| 2011/0110095 | A1 | 5/2011 | Li et al. |
| 2011/0261572 | A1 | 10/2011 | Watanabe et al. |
| 2012/0002429 | A1 | 1/2012 | Watanabe et al. |
| 2012/0320565 | A1 | 12/2012 | Watanabe et al. |
| 2012/0320609 | A1 | 12/2012 | Watanabe et al. |
| 2012/0320610 | A1 | 12/2012 | Watanabe et al. |
| 2012/0320611 | A1 | 12/2012 | Watanabe et al. |

FOREIGN PATENT DOCUMENTS

EP 2336631 A1 6/2011

OTHER PUBLICATIONS

Cree, Inc., International Application No. PCT/US2012/059942, International Search Report and Written Opinion, Feb. 14, 2013.

*Primary Examiner* — Tracie Y Green
(74) *Attorney, Agent, or Firm* — Christopher J. Knors; Moore & Van Allen PLLC

(57) ABSTRACT

A lighting device is disclosed comprising a plurality of light emitters and a heat spreader plate thermally coupled to the plurality of light emitters, wherein the plurality of solid state emitters provides a thermal load upon application of an operating current and voltage, the heat spreader plate dissipating substantially all of the thermal load to an ambient air environment.

38 Claims, 5 Drawing Sheets

LOW THERMAL LOAD, HIGH LUMINOUS SOLID STATE LIGHTING DEVICE

TECHNICAL FIELD

The present disclosure is directed to a lighting device, in particular to a low cost lighting device with a plurality of light emitters and a heat spreader plate element.

BACKGROUND

A large proportion (some estimates are as high as twenty-five percent) of the electricity generated in the United States each year goes to lighting. It is well known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient than solid state light emitters, such as light emitting diodes (LEDs).

Although the development of light emitting diodes has in many ways revolutionized the lighting industry, some of the characteristics of light emitting diodes have presented challenges, some of which have not yet been fully met. Efforts have been ongoing to develop lighting devices that are improved, e.g., with respect to energy efficiency, color rendering index (CRI Ra), contrast, efficacy (lm/W), and/or duration of service. In addition, efforts have been ongoing to develop lighting devices that include solid state light emitters instead of other forms of light emitters. Ideally, the cost of such lighting devices should be comparable with traditional incandescent lighting to facilitate their acceptance and utilization.

Many modern lighting applications utilize high power solid state emitters to provide a desired level of brightness, which can draw large currents, thereby generating significant amounts of heat that must be dissipated to maintain the output of the solid state emitters. Many solid state lighting systems utilize heatsinks in thermal communication with the heat-generating solid state light sources, whereas heatsinks of substantial size and/or subject to exposure to a surrounding environment, aluminum is commonly employed by forming in various shapes by casting, extrusion, and/or machining techniques. Leadframe-based solid state emitter packages also utilize chip-scale heatsinks, with such heatsinks and/or leadframes being fabricated by techniques including stamping with such chip-scale heatsinks typically being arranged along a single non-emitting (e.g., lower) package surface to promote thermal conduction to a surface on which the package is mounted. Such chip-scale heatsinks are generally used as intermediate heat spreaders to conduct heat to other device-scale heat dissipation structures, such as cast or machined heatsinks.

SUMMARY

In a first embodiment, a solid state lighting device is provided. The lighting devices comprises a plurality of solid state emitters; a heat spreader plate of thermally conductive material having a base in thermal communication with the plurality of solid state emitters, and at least one sidewall projecting from the base. The plurality of solid state emitters provides a thermal load upon application of an operating current and voltage, the heat spreader plate dissipating at least a portion of the thermal load to an ambient air environment.

In a second embodiment, a solid state lighting device is provided. The lighting device comprises a plurality of solid state emitters, the plurality of solid state emitters provides a total luminosity of about 700 lumens to about 800 lumens at about 110 lumens per Watt to about 170 lumens per Watt, about 2500 K to about 2900 K correlated color temperature, and greater than or equal to 90 color rendering index, and generating a thermal load not more than about 5 Watts; a heat spreader plate of thermally conductive material having a base in thermal communication with the plurality of solid state emitters, and at least one sidewall projecting in a direction non-parallel from the longitudinal axis of the base. The plurality of solid state emitters generates a total thermal load of less than about 5 Watts upon application of an operating current and voltage, the heat spreader plate dissipating at least a portion of the thermal load to an ambient air environment.

In a third embodiment, a solid state lighting device is provided. The lighting device comprises a plurality of chip-scale solid state emitters; the plurality of chip-scale solid state emitters providing a total luminosity of about 700 lumens to about 800 lumens at about 110 lumens per Watt to about 170 lumens per Watt, and generating a thermal load not more than about 5 Watts; a device-scale heat spreader plate in thermal communication with the at least one chip-scale solid state emitter, the device-scale heat spreader having a base and at least one sidewall portion projecting substantially non-parallel from the longitudinal axis of the base, the heat spreader plate dissipating at least a portion of the thermal load to an ambient air environment, the device scale heat spreader plate having a thermal conductivity of at least 10 W/m-K.

In a fourth embodiment, a lamp or light fixture comprising the lighting device of either the first, second embodiment, and/or third embodiment are provided.

DETAILED DESCRIPTION

Figure 1A:
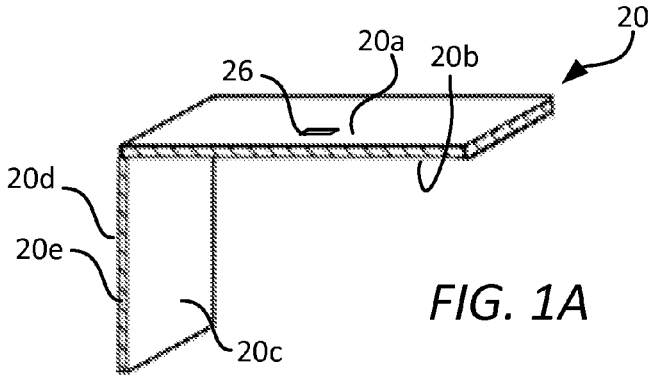
FIGS. 1A, 1B, and 1C are a perspective view, a bottom perspective view, and a side perspective view, respectively, of a heat spreader plate embodiment as disclosed and described herein.

This present disclosure relates to the counter-intuitive path to cost reduction using more LEDs, in some aspects 2-3 times more LEDs than conventionally used for a device of similar luminescence capacity and CRI. For example, rather than utilizing 8-9 center brightness bin parts, 18, 21 or more TOP brightness bin parts be used to generate an LED assembly that is capable of approximately 140 lumens per Watt @ about 750 lumens, with a correlated color temperature of about 2700K, and a color rendering index of about 90 or more. As further discussed below, the many LEDs capable of the LPW above actually draw less current and produce less Watts of heat providing for the modification of trim/heat spreader plate components to minimize material, weight, and packaging constraints on the lighting device. Such configurations allow for the use of heat spreader plates discussed below, with the bulk of the lighting device constructed of lighter, non-metallic components.

Solid State Lighting (SSL) systems, especially those targeted at the residential or light commercial market portions, are limited in their market penetration largely by initial cost. Incumbent technologies (especially incandescent) are inexpensive to buy, albeit consuming large amounts of energy for the amount of light delivered (e.g., 65-75 W for approximately 600 lumens.) Currently, if a residential buyer compares the incumbent solution (a downlight can, trim and bulb) to the SSL solution (costing around 2-3× the incumbent solution), relatively small numbers of those consumers choose the SSL-based solution. It is generally believed that about a 50% reduction in shelve price for an SSL-based downlight may increase sales volume by 4×-5× or more. However, efforts to reduce the cost of SSL-based downlights has reached diminishing returns. For example, SSL downlights produced 4 years ago required the equivalent of 18 power LEDs to provide 650 lumens of light efficiently, whereas that same amount of light can be produced efficiently by 8-9 LEDs produced with current technology. But even if the number of LEDs was again reduced by 50%, the incremental savings (assuming the cost of LEDs continues to drop) would be small relative to the total cost. Moreover, reducing the number of LEDs traditionally generates more heat, not less, as the LEDs are run at higher current to increase lumen efficacy, so taking cost out of this element is problematic.

The power supply is also an element that contributes significantly to the total cost of the SSL product. Moreover, reducing LEDs typically increases power to achieve comparable brightness, which has the opposite effect than desired—increasing power supply cost. Mechanical fixing means cannot be dramatically reduced, because the weight of the product does not change substantially with the reduction of LEDs. Some conventional solid state lighting downlights utilize the trim and/or reflector as a means of dissipating heat, adding to the material cost of the device. Integral heat spreader plate/trim component configurations essentially fix the packaging costs and will remain largely the same without the implementation of the presently disclosed solutions.

Thus, Applicants have discovered and implemented substantial cost, weight, and packaging reduction by using a large number of solid state light emitters, that when combined, provide for a brightness of about 750 total lumens or more, at about 100 to about 140 Watts/lumens, said plurality of emitters generating about 5 Watts of heat or less, in combination with a device-scale heat spreader plate in thermal communication with the light emitters. This configuration provides for minimizing heat spreader plate material. In this configuration, more metal components can be replaced with plastic and the lighting device can be manufactured, packaged, and/or transported more economically.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure. Relative terms, such as "lower", "bottom", "below", "upper", "top" or "above," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The phrase "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The phrase "thermally coupled", as used herein, means that heat transfer occurs between (or among) the two (or more) items that are thermally coupled. Such heat transfer encompasses any and all types of heat transfer, regardless of how the heat is transferred between or among the items. That is, the heat transfer between (or among) items can be by conduction, convection, radiation, or any combinations thereof, and can be directly from one of the items to the other, or indirectly through one or more intervening elements or spaces (which can be solid, liquid and/or gaseous) of any shape, size and composition. The expression "thermally coupled" encompasses structures that are "adjacent" (as defined herein) to one another. In some configurations, the majority of the heat transferred from the light source is transferred by conduction; in other situations or configurations, the majority of the heat that is transferred from the light source is transferred by convection; and in some situations or configurations, the majority of the heat that is transferred from the light source is transferred by a combination of conduction and convection.

The term "adjacent", as used herein to refer to a spatial relationship between a first structure and a second structure, means that the first and second structures are next to each other (for example, where two elements are adjacent to each other, no other element is positioned between them).

The phrase "chip-scale solid state emitter" as used herein refers to an element selected from (a) a bare solid state emitter chip, (b) a combination of a solid state emitter chip and an encapsulant; or (c) a leadframe-based solid state emitter chip package, with the emitter element(s) having a maximum major dimension (e.g., height, width, diameter) of about 2.5 cm or less, more preferably about 1.25 cm or less.

The phrase "device-scale heat spreader plate" as used herein refers to a heatsink suitable for dissipating substantially all of the steady state thermal load from at least one chip-scale solid state emitter to an ambient environment. Throughout this disclosure, reference to the term "heat spreader plate" shall be in reference to the device-scale heat spreader plate, unless expressed otherwise.

The phrase "chip-scale heatsink" as used herein refers to a heatsink that is smaller than and/or has less thermal dissipation capability than a device-scale heatsink.

The phrase "substantially non-metallic" as used herein refers to a structure and/or component that is predominately non-metallic in its construction. For example, a substantially non-metallic trim element and/or substantially non-metallic reflector would be more than 90% non-metallic in mass, more than 95% non-metallic in mass, more than 99% non-metallic in mass. By way of example, "substantially non-metallic" is inclusive of a plastic trim and/or reflector component that has been sputter coated or electroplated with a thin film of reflective metal. The phrase "substantially non-metallic" is inclusive of completely metal-free components.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The need to adequately remove heat generated by the light source is particularly pronounced with respect to solid state light emitters. Light emitting diodes, for example, have operating lifetimes of decades, as opposed to just months or one or two years for many incandescent bulbs, but a light emitting diode's lifetime is usually significantly shortened if it operates at elevated temperatures. In addition, the intensity of light emitted from some solid state light emitters varies based on ambient temperature. The ambient temperature can be localized on a package/leadframe. For example, red light emitting diodes often have a very strong temperature dependence (e.g., AlInGaP light emitting diodes can reduce in optical output by about 20% when heated beyond about 40 degrees C., that is, approximately −0.5% per degree C.; and blue InGaN+YAG:Ce light emitting diodes can reduce by about −0.15%/degree C.).

In certain aspects, the present disclosure comprises lighting devices including solid state light emitters as light sources which emit light of different colors which, when mixed, are perceived as the desired color for the output light (e.g., white or near-white). As noted above, the intensity of light emitted by many solid state light emitters, when supplied with a given current, can vary as a result of temperature change. The desire to maintain a relatively stable color of light output while providing sufficient heat transfer management is provided by the lighting device configuration of the present disclosure.

With lighting devices that include light emitting diodes, the lower the thermal resistance from the light emitting diode to the environment, the greater light that can be generated from a lighting device without exceeding the optimum maximum junction temperature (or, similar amounts of light can be generated with a lower light emitting diode junction temperature, possibly enabling longer light emitting diode life). The phrase "junction temperature" in this context refers to an electrical junction disposed on a solid state emitter chip, such as a wirebond or other contact.

In related devices, heat management structures that are directly in contact with the light emitting diodes, or with the circuit board on which the light emitting diodes are mounted, need to have sufficient cross-sectional area to conduct the heat effectively to the heat spreader plate. For example, where a heat management structure might include fin-like structure that are of a thickness of about 1.5 mm, in order to conduct heat from the heat management structure into the environment, it might require a metal base that is 5 mm thick, 6 mm thick or even thicker in order to conduct heat from the light emitting diodes to the fin-like structure. Such structures can require additional space, making the lighting device larger, heavier, and/or more complicated to assemble/install.

In many cases, traditional heat management structure or heatsinks require a large amount of space, almost exclusively above the plane of a light emitting diode circuit board. In some cases, the circuit board is mounted to a flat surface to provide effective conduction, and the heatsink consumes much of this space, and so in many of such devices, the circuit board is attached to the opposite face of the heatsink with portions of the heatsink extending in an upward direction from the board. Since it is desirable for the total height of a fixture (e.g., depth that the fixture intrudes into a ceiling) to be minimized, open space above the ceiling plane for lighting fixtures has in many situations decreased.

Typical passive thermal solutions, such as extruded or cast heatsinks, are simple and effective, but use a significant amount of material in order to conduct the required amount of heat away from the lighting device. The presently disclosed lighting device configuration provides for a significant reduction in the amount of heatsink material used in the device. In one aspect, the reduction in the amount of material constituting the heat spreader plate is provided by employing a large number of LEDs generating a total amount of heat less than conventional devices and thereby requiring relatively less material for heat transfer.

Various embodiments of the present disclosure contemplate a large number of light emitters. In such embodiments, the light emitters can be any desired light emitter (or any desired combination of light emitters). The light emitters can consist of a single color of light, or can comprise a plurality of sources of light which can be any combination of the same types of components and/or different types of light emitters, and which can be any combination of emitters that emit light of the same or similar wavelength(s) (or wavelength ranges), and/or of different wavelength(s) (or wavelength ranges).

The lighting device emitters can comprise a solid state light emitter and a luminescent material, for example, a light emitting diode chip, a bullet-shaped transparent housing to cover the light emitting diode chip, leads to supply current to the light emitting diode chip, and optionally a cup reflector for reflecting the emission of the light emitting diode chip in a uniform direction, in which the light emitting diode chip is encapsulated. The luminescent material or phosphor can be dispersed on the LED chip or remotely dispersed so as to be excited with the light that has been emitted from the light emitting diode chip.

In one embodiment, the presently disclosed lighting device comprises a large number of light emitters thermally coupled to the heat spreader plate. In one aspect, the light emitters are chip-scale solid state emitters. The large number of emitters can be in excess of 5, 10, 12, 14, 16, 18, 20, or more. In one embodiment, the total number of emitters (e.g., chip-scale solid state emitters) is such that the lighting device provides about 110 to about 170 lumens per Watt at about 700-800 lumens. In one aspect, the lighting device provides about 140 lumens per Watt at 750 lumens. The device, in combination with the large number of chip-scale solid state emitters can be configured with a correlated color temperature of about 2500-2900 Kelvin. The device can be configured for a color rendering index of at least 90. In another aspect, the lighting device provides about 140 lumens per Watt at 750 lumens, a correlated color temperature of about 2700 Kelvin, and a color rendering index of at least 90.

In one embodiment, the lighting device is configured with a large number of light emitters, for example, chip-scale solid state emitters, with about 100 LPW at the system level. In this configuration, the power supply needs only to handle 6-7 W of power. Lower power (and correspondingly lower current) provides for smaller components, less expensive magnetics, and more integration of secondary component, e.g., FETs, etc., on or into the main controller IC. All of these improvements provide for a step function cost decrease. By way of example, at 100 LPW, the amount of heat dissipated by the total lighting device drops from about 10 W (about 12 W total, which is approximated at about 2 W in radiant energy [e.g., light], and about 10 W in heat) to about 4-5 W, providing for about a 50% reduction in heat to be managed. In one aspect, the present lighting device configuration provides for eliminating the requirement for expensive thermal gap pads for cooling power supply components, and provides for a reduction in the amount of metal (e.g., aluminum) utilized in the lighting device. Thus, the present lighting device configuration provides for the use of more plastic (or less metal, or plastic with minimal metal) and elimination or reduction of expensive graphite heat spreaders and thermal gap pads. In addition, the mechanical retention means can be much less aggressive, and therefore, of lower cost.

Heat Spreader Plate Elements

In one or combinations of aspects presently disclosed, the heat spreader plate can be made of any suitable desired material, and can be of any suitable shape. In general, the heat spreader plate has high thermal conductivity characteristics, e.g., it has a thermal conductivity of at least 1 W/m-K. In some aspects, the heat spreader plate can be or contain (or function as) a heat pipe. In other aspects, the heat spreader plate may be provided as a highly thermally conductive material, such as a metal sheet or strip, a graphite sheet/strip, or graphite foam.

Heat spreader plate and/or sidewall portions can independently be made of any suitable desired material, and can be of any suitable shape and/or texture. In one aspect, a heat spreader plate has high thermal conductivity characteristics, e.g., it has a thermal conductivity of at least 5 W/m-K, at least 10 W/m-K, and at least 100 W/m-K. In other aspects, the heat spreader plate has a thermal conductivity of at least 200 W/m-K. Representative examples of materials which are suitable for making a heat spreader plate include, among a wide variety of other materials, aluminum or aluminum alloy, copper, copper alloys, tin, tin alloys, brass, bronze, tungsten, tungsten alloys, steels, vanadium, vanadium alloys, gold, gold alloys, platinum, platinum alloys, palladium, palladium alloys, silver, silver alloys, other metal alloys, liquid crystal polymer, filled engineering polymers (e.g., polyphenylene sulfide (PPS)), thermoset bulk molded compounds or other composite materials and combinations thereof. Each part of the heat spreader plate can be formed of any suitable thermally conductive material or materials, i.e., the entire heat spreader plate can be formed of a single material, combinations of materials, or different portions of the heat spreader plate (e.g., the base or projecting sidewall portions and/or segments of any of these) can be formed of different materials or different combinations of materials, and can be made in any suitable way or ways. For instance, the base can comprise a heat spreader plate made of any suitable material, the projecting sidewall portions can be made by any suitable method, e.g., by shaping/stamping. Aluminum and alloys thereof are particularly desirably due to reasonable cost and corrosion resistance, for example, to fabricate the base and projecting sidewall portions.

In certain aspects the heat spreader plate and projecting sidewall are of an integral construction with at least one bend resulting in the projecting sidewall. Sidewall portions of the heat spreader plate can be bent into multiple sections that are angular or curved in cross-section. Bends may be formed using mechanical and/or hydraulic rams or presses, or other conventional bending apparatuses, optionally aided by use of forms or stops to promote attainment of desired shapes. Progressive die shaping or any other suitable method may be used to form such bends. One or more apertures may be defined in the base or the sidewall, and the sidewall portions may include multiple spatially separated projecting portions, e.g.

fins, to facilitate air circulation and/or provide increased surface area, thereby aiding in dissipation of heat. Such fins can be regularly or irregularly spaced-apart and be of the same or different length.

In some embodiments, including some embodiments that include or do not include any of the features as discussed above, the base of the heat spreader plate comprises an outer region defining at least a portion of a periphery. In some of such embodiments, the periphery of the base is substantially circular or annular, circular annular, substantially square annular, substantially polygonal annular, or can be substantially toroidal shape, for example a shape which could be generated by rotating a planar closed curve about a line that lies in the same plane as the curve but does not intersect the curve, a doughnut shape, as well as shapes which would be generated by rotating squares, triangles, irregular (abstract) shapes, etc. about a line that lies in the same plane. The periphery of the base can be substantially toroidal, e.g., a structure that can include one or more gaps.

The top and or bottom surface of the base and/or sidewall portions can be smooth and/or textured. The texturing can include projections of any reasonable size or shape of a predetermined length and/or width and/or height. Such texturing can be configured to maximize the surface contact with the ambient environment for heat transfer, for example.

A further aspect of certain embodiments of the present disclosure relates to the spacing of the sidewall projecting elements. The spacing of the sidewall projecting elements may be such that all, substantially all, or most of the length of the sidewall projecting elements may be effective in dissipating heat. The spacing between the sidewall projecting elements can be selected so as to reduce or eliminate interaction between adjacent sidewall projecting elements. Additionally, as the heat is dissipated inward along the length of the sidewall projecting elements, the spacing between the sidewall projecting elements can decrease without causing substantial loss in the effectiveness of neighboring sidewall projecting elements. The spacing between sidewall projecting elements should be sufficient to allow air flow between them, and the distance can be selected so that adjacent sidewall projecting elements do not substantially reduce the amount of heat dissipated by each other.

As discussed above, the heat spreader plate is configured for use with a plurality of solid state emitters, and corresponding lighting device fixtures so as to dissipate substantially all of the steady state thermal load of the plurality of solid state emitters to an ambient environment (e.g., an ambient air environment). Such heat spreader plates may be sized and shaped to dissipate significant steady state thermal loads to an ambient air environment, without causing excess solid state emitter junction temperatures that would detrimentally shorten service life of such emitter(s).

In certain aspects, the heat spreader plate dissipates significant steady state thermal loads of up to about 4 Watts, up to about 5 Watts, up to about 6 Watts. One aspect of the present disclosure is to provide a plurality of light emitters that generate about 5 Watts of heat or less, thereby reducing the amount and/or size of the material constituting the heat spreader plate. Reducing the total heat generated by the light emitters in combination with the heat spreader plate can provide for longer-life devices. For example, operation of a solid state emitter at a junction temperature of 85 degrees Centigrade may provide an average solid state emitter life of 50,000 hours or greater, while temperatures of about 95 degrees Centigrade, 105 degrees Centigrade, 115 degrees Centigrade, and 125 degrees Centigrade may result in average service life durations of 25,000 hours, 12,000 hours, 6,000 hours, and 3,000 hours, respectively. In one embodiment, a device-scale heat spreader plate dissipates a steady state thermal load of at least about 2 Watts, at least about 3 W, at least about 4 Watts, and at least about 5 Watts in an ambient air environment of about 35 degrees Centigrade while maintaining a junction temperature of the solid state emitter at or below about 95 degrees Centigrade.

In one aspect, the solid state lighting device disclosed herein comprises a plurality of solid state emitters that provides a total luminosity of about 750 lumens at about 140 lumens per Watt, about 2700 K correlated color temperature, and greater than or equal to 90 color rendering index.

In another aspect, including some aspects that include or do not include any of the features as discussed above, the solid state lighting device has a thermal load, generated by the plurality of solid state light emitters, not more than about 5 Watts.

In another aspect, including some aspects that include or do not include any of the features as discussed above, the plurality of solid state emitters are LEDs of at least 18 in number. In other aspects, the plurality of solid state emitters are LEDs of at least 20 in number. In an exemplary embodiment, LEDs can be AlGaN and AlGaInN ultraviolet LED chips radiationally coupled to YAG-based or TAG-based yellow phosphor and/or group III nitride-based blue LED chips, such as GaN-based blue LED chips, are used together with a radiationally coupled YAG-based or TAG-based yellow phosphor. As another example, LEDs of group III-nitride-based blue LED chips and/or group-III nitride-based ultraviolet LED chips with a combination or mixture of red, green and orange phosphor can be used. Other combinations of LEDs and phosphors can be used in practicing the present disclosure.

Some embodiments the lighting device can comprise a power line that can be connected to a source of power (such as a branch circuit, a battery, a photovoltaic collector, etc.) and that can supply power to an electrical connector (or directly to the lighting device). A power line can be any structure that can carry electrical energy and supply it to an electrical connector on a fixture element and/or to a lighting device.

In some aspects, the lighting device can further include one or more circuitry components, e.g., drive electronics for supplying and controlling current passed through at least one of the solid state light emitters in the lighting device. For example, such circuitry can include at least one contact, at least one leadframe, at least one current regulator, at least one power control, at least one voltage control, at least one boost, at least one capacitor, at least one temperature compensation circuit, and/or at least one bridge rectifier, such components being readily designed to meet whatever current flow characteristics are desired.

The lighting device can further comprise any desired electrical connector, a wide variety of which are available, e.g., an Edison connector (for insertion in an Edison socket), a GU-24 connector, etc., or may be directly wired to an electrical branch circuit. In one aspect, the lighting device is a self-ballasted device. For example, in some embodiments, the lighting device can be directly connected to AC current (e.g., by being plugged into a wall receptacle, by being screwed into an Edison socket, by being hard-wired into a branch circuit, etc.). In another aspect, some or all of the energy supplied to the plurality of light emitters is supplied by one or more batteries and/or by one or more photovoltaic energy collection device (i.e., a device which includes one or more photovoltaic cells which converts energy from the sun into electrical energy).

In one embodiment, a metallic sheet comprising electrically conductive traces deposited on or over both sides thereof (optionally including intervening dielectric layers) can be employed with the lighting device herein disclosed so as to provide electrical connections to suitably located electrically operable elements associated with the plurality of solid state light emitters. In one embodiment, a metallic (or other electrically conductive material) sheet is attached a heat spreader plate is formed is electrically active, such that one or more electrical connections to electrically operative components include the metallic sheet.

Reflector/Trim

The presently disclosed lighting devices may further comprise a fixture element separate or integral with the above heat spreader plate and plurality of solid state light emitters. The fixture element can comprise a housing, a mounting structure, and/or an enclosing structure. A fixture element, a housing, a mounting structure and/or an enclosing structure made of any of such materials and having any of such shapes can be employed. The lighting device as presently disclosed can include additional components, such as a reflector, trim, and/or downlight can or assembly. In addition, the lighting device can include attachment means for the trim/downlight portions for installation.

In one aspect, to reduce the total cost of the lighting device and/or reduce weight and/or packaging constraints, the reflector and/or trim can be configured of plastic or a thermally conductive plastic, which can be of integral construction (e.g., "one-piece"). In other aspects, the reflector and/or trim can be separate components configured for assembly prior to installation. Suitable assembly configurations can be used, such as snap-fit or snap-together, and the like. In one preferred aspect, substantially all of the fixture element is constructed of plastic or plastic alloys. Thus, in one aspect, the ratio of thermal conductivity of the heat spreader plate and the trim element and/or the reflector is between about 10:1 to about 1000:1. For example, the heat spreader plate can be of metal with a thermal conductivity of greater than 10 W/m-K., and the trim and/or reflector of plastic with a thermal conductivity of less than 1 W/m-K.

In one aspect, a portion of the polymeric trim/reflector elements can be constructed of thermally conductive plastic so as to aid in thermal dissipation. For example, portions of the polymeric trim being thermally conductive can constitute less than 50% total material content. In one aspect, a portion of the trim/element is co-molded, over-molded, mechanically attached (e.g., via snaps, adhesives or fasteners) with thermally conductive polymer. The thermally conductive polymer portion (or a portion thereof) can be generally exposed to the ambient. In one example, a thermal path between the heat spreader plate and the outside ambient air provided by way of a portion of thermally conductive polymer is provided, where the length, width and thickness being that which satisfies any necessary requirement for downlights to be suitable for use in insulated ceilings, irrespective of the thermal load, e.g., even at 2-4 W thermal load.

In one aspect, the present lighting device comprises a heat spreader plate that extends beyond the lateral extent of a reflector that is typically integrated into a conventional lead-frame-based emitter package. Such heat spreader plate preferably includes a base and one or more outwardly projecting sidewall portion(s) with the sidewall portion(s) extending in a direction non-parallel to the longitudinal axis (or diameter) of the base. In one aspect, the base portion and sidewall portion (s) form one or more of an L-like shape arrangement. The base portion optionally is adapted to receive or support at least a portion of a reflector arranged to reflect light emitted by one or more solid state emitters and/or electrical components and/or connectors, leads, traces, and/or brackets or other attachment/mounting elements. This configuration allows for a reduction in the amount of heat spreader plate material required and a reduction in overhead clearance.

Other sidewall shapes can be used, for example, formed by bending the sidewall. Such bends may cause sidewall portions of a heat spreader plate to extend in a direction non-coplanar with (i.e., non-parallel to a plane definable through) a base portion of the heat spreader plate (e.g., upward) to form a cup-like inner wall portion adapted to receive at least a portion of a reflector, and then to change direction (e.g., downward) to form an outer wall portion partially or fully circumscribing the fixture/reflector. A gap may be maintained between the inner wall of the projecting sidewalls and the fixture/reflector portions to permit air circulation there between.

In one embodiment, the projecting portion(s) or sidewall portion(s) of the heat spreader plate are arranged to contact a reflector and/or surround the reflector and/or form a housing or a cavity between the reflector and the heat spreader plate. The cavity can be configured to contain electrical components such as a ballast, power supply, IC boards, Edison socket, wiring, and the like. The cavity can comprise a housing. Such arrangement may lend structural support to the entire lighting device, the reflector and/or lens, and ease design and assembly of a lighting device through use of the heat spreader plate as a structural support component.

In some embodiments, one or more structures can be attached to the lighting device which engages structure of the fixture element to hold the lighting device in place relative to the fixture element. In some embodiments, the lighting device can be biased against the fixture element, e.g., so that a flange portion of the trim element is maintained in contact (and forced against) a bottom region of the fixture element (e.g., a circular extremity of a can light housing). For example, some embodiments include one or more spring retainer clips (sometimes referred to as "chicken claws") which comprise at least first and second spring-loaded arms (attached to the trim element) and at least one engagement element (attached to the fixture element), the first and second spring-loaded arms being spring biased apart from each other (or toward each other) into contact with opposite sides of the engagement element, creating friction which holds the trim element in position relative to the fixture element, while permitting the trim element to be moved to different positions relative to the fixture element. The spring-loaded arms can be spring-biased apart from each other (e.g., into contact with opposite sides of a generally C-shaped engagement element), or they can be spring-biased toward each other (e.g., into contact with opposite sides of a block-shaped engagement element). In some embodiments, the spring-loaded arms can have a hook at a remote location, which can prevent the lighting device from being moved away from the fixture element beyond a desired extreme location (e.g., to prevent the lighting device from falling out of the fixture element).

At least one of the portions can be configured to structurally support one or more components of the lighting device, such as a lens and/or reflector, as further discussed below. In one aspect the at least one sidewall portion projects substantially parallel to the principle axis of the lighting device (as defined by a line bisecting the lens/reflector/trim). Such portion(s) may directly contact the outside surface of the lens and/or reflector, or may support the lens and/or reflector with one or more intervening materials.

In another aspect, the presently disclosed lighting device configuration provides for the elimination of an integral metal trim, the trim being capable of fabrication from plastic. In such configurations, the trim can be removable from the main body of the downlight. Packaging can then be made in a way that allows the body of the downlight and the trim to nest together, reduction the height of the packaging by one third or more, and therefore reducing the packaging cost. In addition, by making most of the product from plastic, aggressive "snap once" assembly features can be employed (or integrated) allowing for a significant reduction in screws and fasteners, and a corresponding reduction in total device cost, as well as assembly time.

In some embodiments, the fixture element further comprises an electrical connector that engages the electrical connector on the lighting device, e.g., the electrical connector connected to the fixture element is complementary to the electrical connector connected to the lighting device (for example, the fixture element can comprise an Edison socket into which an Edison plug on the lighting device is receivable, the fixture element can comprise a GU24 socket into which GU24 pins on the lighting device are receivable, etc.).

In some embodiments, including some embodiments that include or do not include any of the features as discussed above, most or substantially all of the heat spreader plate is spaced from the fixture i.e., it does not contact the fixture or components of the fixture. Providing a heat spreader plate with side wall projections that are spaced from a fixture can allow for air to flow through and/or around the sidewall projection portions. Other heat dissipating elements can be attached to an outer region/edge or top/bottom surface of the sidewall projections spaced from the fixture to provide for heat transfer over a larger surface area to the ambient surrounding the sidewall portions in the fixture.

A fixture may be mechanically attached to a heat spreader plate in any suitable way, e.g., with screws, or any other attachment means. In some embodiments, for example, a fixture (reflector/lens) and a plurality of light emitters are both mounted on a first side (e.g., bottom side) of the base of the heat spreader plate. Thus, in some embodiments, including some embodiments that include or do not include any of the features as discussed above, a heat spreader plate has a top side and a bottom side, a plurality of light emitters deposited on the bottom side of the base, and a light mixing chamber extending from the bottom side of the base. Any lighting device in accordance with the present disclosure can comprise one or more lenses/reflectors. Any materials and shapes can be employed in embodiments that include a reflector and/or lens (or plural lenses). The lens can have any desired effect on incident light (or no effect), such as focusing, diffusing, etc. In embodiments in accordance with the present disclosure that include a lens (or plural lenses), the lens (or lenses) can be positioned in any suitable location and orientation.

In one embodiment, the heat spreader plate (alone or in combination with the reflector/lens) can be configured to be received by a downlight can. Thus, the lighting device of the present disclosure provides for the capability of exposing a heat spreader plate to the air inside a downlight can. While minimal heat transfer will occur in this configuration from convection (due to the possibility of stagnant air in the downlight can), some convection is provided. The heat spreader plate also provides an opportunity for radiative cooling, depending on the emissivity of the heat spreader plate. The lighting device comprising an exposed heat spreader plate will provide for lower total device height so as to fit into shallow cans, and/or to be incorporated into slope ceiling fixtures. Any or all of the above features of the lighting device of the present disclosure provides for thermal separation between the LED heat source and the self generated heat in the power supply. Any or all of the above features of the lighting device of the present disclosure provides additional cooling capability from convection and radiation.

The inventive subject matter may be more fully understood with reference to the accompanying drawings and the following detailed description of the inventive subject matter.

FIGS. 1-6 illustrate various heat spreader plate configurations and lighting devices configured with the heat spreader plate in accordance with the present disclosure. FIGS. 1A, 1B, and 1C are a perspective view, bottom perspective view, and side perspective view, respectively, of heat spreader plate 20. With reference to FIGS. 1A, 1B, and 1C, heat spreader plate 20 comprises a base having a top surface 20*a* and bottom surface 20*b* and a single sidewall portion 20*e* having a first surface 20*d* contiguous with the top surface 20*a* of the base, and a second surface 20*c* contiguous with the bottom surface 20*b* of the base. The transition from the base to the projecting sidewall (as shown) is of a generally edge-like transition, forming an L-like configuration. Other structures and bends can be used. The thickness of the base (as measured from the top surface 20*a* and bottom surface 20*b*) can be the same or different from the thickness of the projecting sidewall (as measured from the first surface 20*d* and second surface 20*c*). In one aspect, the sidewall is of a thinner cross-sectional thickness than the base and/or tapers in thickness from the base.

Figure 1B:
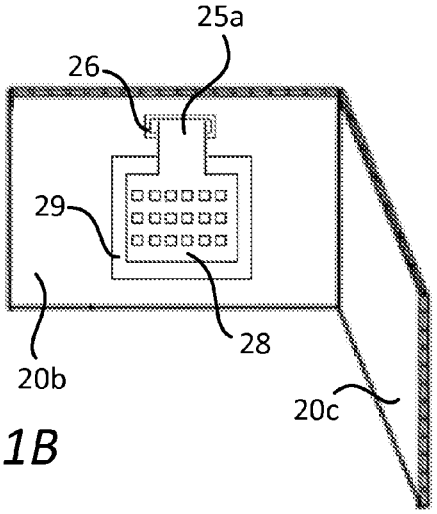
Figure 1C:
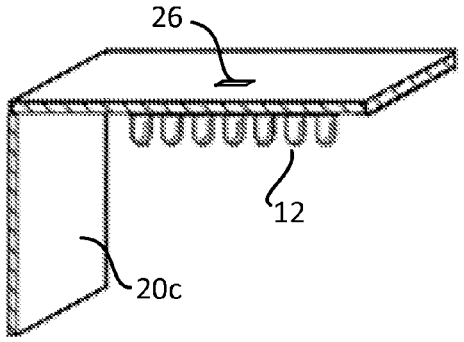

Referring now to FIGS. 1B and 1C, heat spreader plate has a trace and/or bonding pad having an insulating region 29 and bonding pads configured to engage LEDs 12 associated with electrical wiring 25*a* can be provided on bottom surface 20*b* of the base. Electrical connection to a suitable power source or other circuitry can be provided via optional aperture 26 in the bottom surface 20*b* through the top side 20*a* of the base, the opening sized to accommodate at least one electrical conductor (e.g. wiring) 25*a*. Alternatively, the wiring can be routed around the base. In some embodiments, light emitting diodes can be mounted on a first circuit board (a "light emitting diode circuit board") and electronic circuitry capable of converting AC line voltage into DC voltage, suitable for being supplied to light emitting diodes, can be mounted on a second circuit board (a "driver circuit board"). Line voltage is supplied to the electrical connector and passed along to the driver circuit board, the line voltage being converted to DC voltage suitable for being supplied to light emitting diodes in the driver circuit board, and the DC voltage passed along to the light emitting diode circuit board where it is then supplied to the light emitting diodes. In some embodiments, the first circuit board is a metal core circuit board (MCPCB). In one embodiment, thermal communication between the plurality of solid state emitters and the heat spreader plate may optionally be facilitated by one or more active or passive intervening elements or devices. While not illustrated in the figures, thermal grease, thermal pads, graphite sheets heatpipes, thermoelectric coolers, chip-scale heat spreader plates, or other techniques known to those of skill in the art may be used to increase the thermal coupling between the light emitters and/or packaging and the heat spreader plate and/or between portions or components of these elements. In other aspects, the lighting device is configured without thermal grease, thermal pads, graphite sheets so as to reduce the overall cost of the device.

Figure 2:
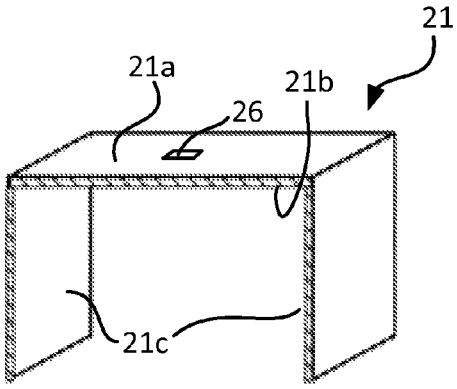
FIG. 2 is a perspective view of alternate embodiment heat spreader plate as disclosed and described herein.
Figure 3:
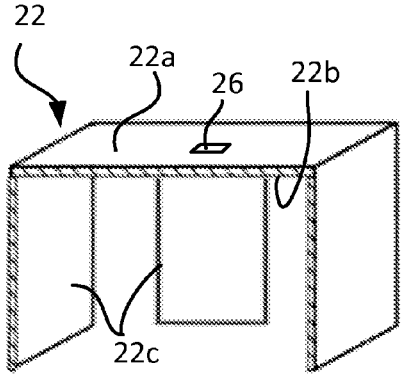
FIG. 3 is a perspective view of alternate embodiment heat spreader plate as disclosed and described herein.

FIGS. 2 and 3 are perspective views of alternate embodiment heat spreader plates 21 and 22, respectively, having bases with top surface 21*a* and bottom surface 21*b*, 220*b*, respectively, having a plurality of projecting sidewalls 21*c*, 22*c*, respectively, the projecting sidewalls having first and second surfaces contiguous with the base top and bottom surfaces, respectively. Heat spreader plates 20, 21, and 22 may be formed, for example, by progressive die shaping, stamping one or more sheets of material (or segments of differing size or extent) to form a blank and shaping the blank (e.g., bending) to arrive and the desired shape. The sidewall portion(s) may include a substantially continuous single sidewall, or multiple connected sidewalls, e.g., multiple spatially segregated sidewall segments or segments. In one aspect, a plurality of spatially segregated projecting sidewall portions extend outward from a central base portion of the heat spreader plate and extend beyond a peripheral edge of a reflector element of a fixture. Any suitable number of sidewall portions or segments thereof may be employed. In one embodiment, the number of sidewall portions or segments provided in a heat spreader plate includes at least one ("L-shaped), but can be configured with 2, 3, 4, 5, 6 or more. An even or odd number of sidewall portions or segments may be provided. Projecting sidewalls may be of equal or unequal sizes, and may be symmetrically or asymmetrically arranged depending upon design and operating criteria of a resulting solid state lighting device.

Figure 4:
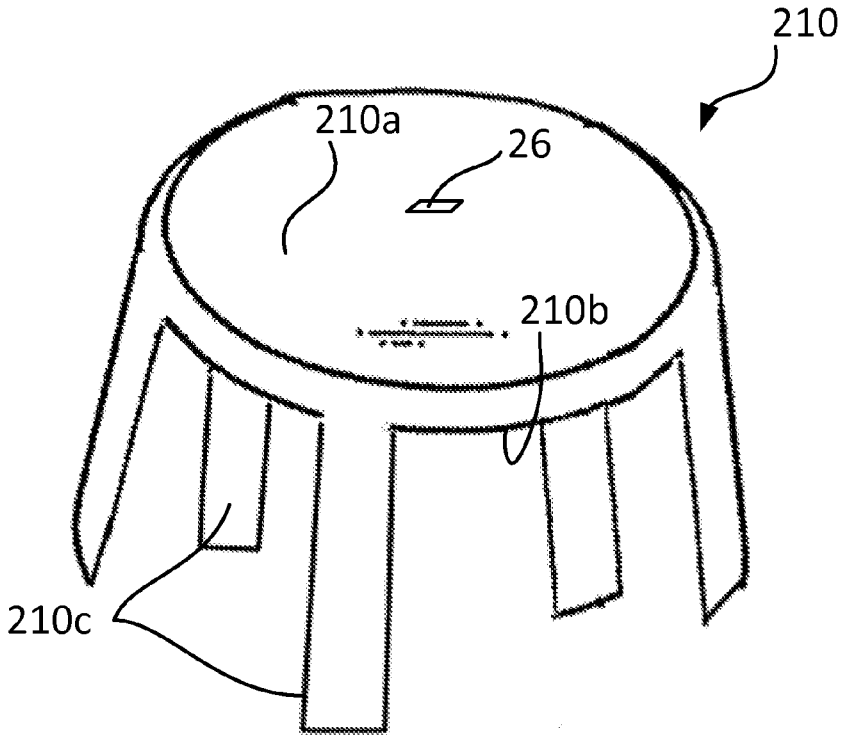
FIG. 4 is a top perspective view of alternate embodiment heat spreader plate as disclosed and described herein.
Figure 5:
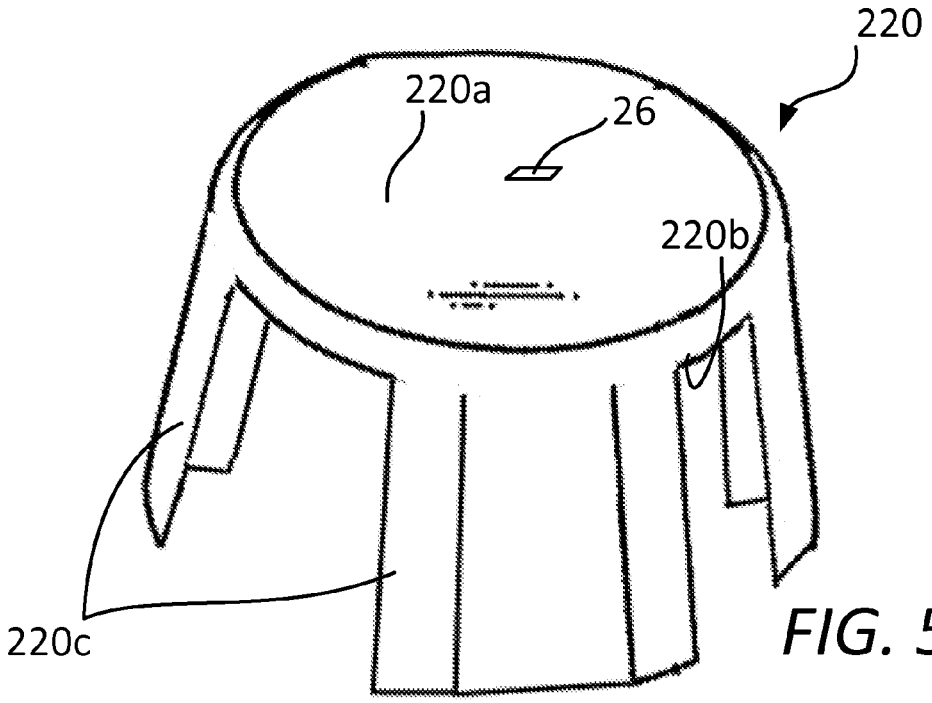
FIG. 5 is a top perspective view of alternate embodiment heat spreader plate as disclosed and described herein.

FIGS. 4 and 5 are alternate embodiment heat spreader plates 210 and 220, respectively, having generally annular shaped bases with top surfaces 210*a*, 220*a*, respectively, bottom surfaces 210*b*, 220*b*, respectively, having projecting sidewall portions 210*c*, 220*c*, respectively, the projecting sidewalls having first and second surfaces contiguous with the base top and bottom surfaces, respectively. Sidewall portions 210*c*, 220*c* can independently be of any length, preferably a length appropriate for the lighting device. The sidewall portions can be shaped with angular bends or arcuate bends. The sidewall portions can be symmetrically or asymmetrically arranged about the base. The transition from either surface of the base to the sidewall portions can be edge-like or rounded. Heat spreader plates 210 and 220 may be formed, for example, by progressive die shaping, or by stamping one or more sheets of material (or segments of differing size or extent) to form a blank and shaping the blank (e.g., bending) to arrive and the desired shape.

Figure 6:
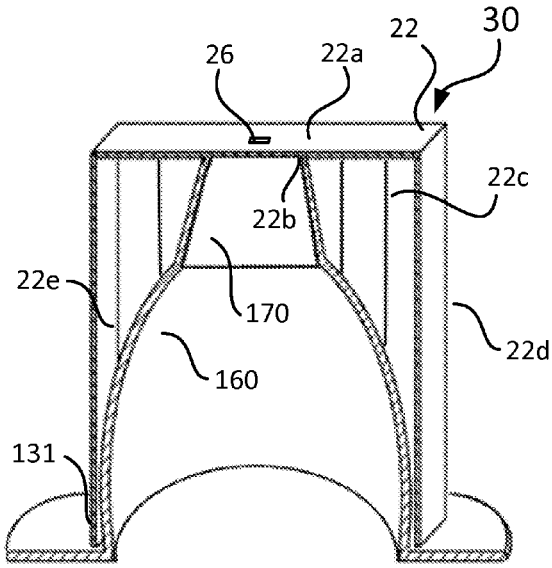
FIG. 6 is a sectional view of a lighting device fixture with the heat spreader plate embodiment similar to that of FIG. 3 as disclosed and described herein.

FIG. 6 is a sectional view of lighting device fixture 30 with heat spreader plate 22 of FIG. 3, positioned about driver sub-assembly/reflector 170 and trim 160.

Figure 7:
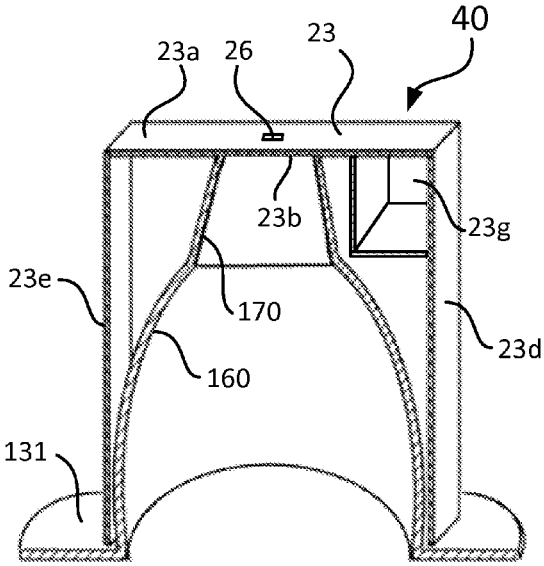
FIG. 7 is a sectional view of a lighting device fixture with a heat spreader plate embodiment as disclosed and described herein.

FIG. 7 is a sectional view of lighting device fixture 40 with heat spreader plate 23 similar to that of FIG. 2 having at least one housing 23*g* configured for electronics (e.g., junction box), positioned about driver sub-assembly/reflector 170 and trim 160.

Figure 8:
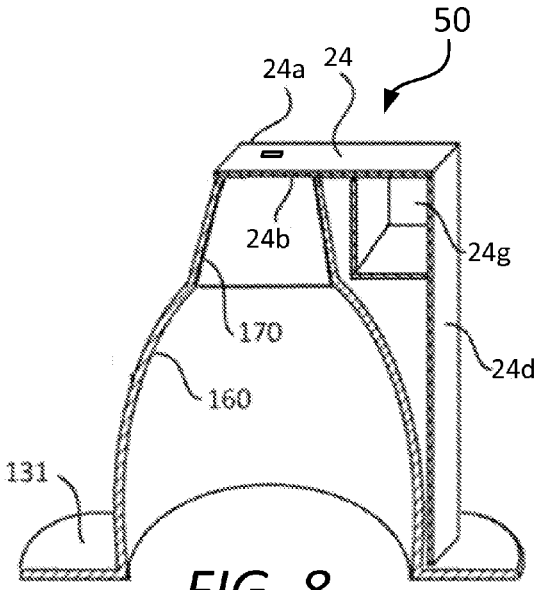
FIG. 8 is a sectional view of a lighting device fixture with the heat spreader plate embodiment similar to that of FIG. 2 as disclosed and described herein.

FIG. 8 is a sectional view of lighting device fixture 50 with heat spreader plate 24 similar to that of FIG. 1 having single housing 24*g*, positioned about driver sub-assembly/reflector 170 and trim 160. Heat spreader plates 22, 23 and 24 may be formed, for example, by progressive die shaping, or by stamping one or more sheets of material (or segments of differing size or extent) to form a blank and shaping the blank (e.g., bending) to arrive and the desired shape. Housings 23*g* and 24*g*, which can be of metal or non-metal construction, can be welded or glued to heat spreader plate.

Figure 9:
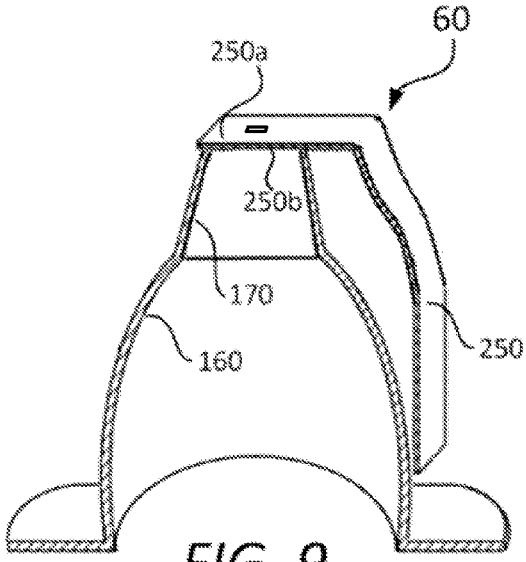
FIG. 9 is a sectional view of a lighting device fixture with a heat spreader plate embodiment similar to that of FIG. 1 as disclosed and described herein.

FIG. 9 is a sectional view of lighting device fixture 60 with shaped heat spreader plate 250 having top surface 250*a* and bottom surface 250*b*, with plate 250 asymmetrically positioned about driver sub-assembly/reflector 170 and trim 160. Shape of plate 27 can conform to the outer perimeter of the driver sub-assembly/reflector 170 and/or trim 160 components of the lighting device.

Figure 10:
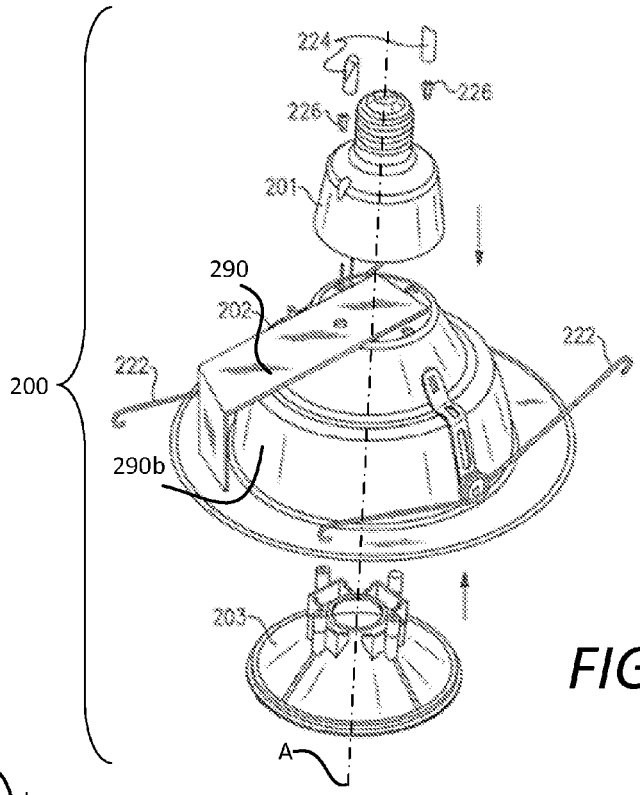
FIG. 10 is an exploded perspective view of an exemplary low-cost lighting device having a heat spreader plate embodiment as disclosed and described herein.

FIG. 10 is an exploded perspective view of an exemplary low-cost lighting device 200 having a heat spreader plate embodiment as presently disclosed in combination with a plurality of LEDs. Lighting device 200 comprises a driver sub-assembly 201, a non-metallic trim sub-assembly 202 and a mixing chamber sub-assembly 203 aligned along principle axis A. Lighting device 200 is shown with heat spreader plate 290 having a single sidewall projection 290*a* (which can individually have any suitable outer region or regions), one or more spacer elements (each of any suitable shape and size) positioned between the driver sub-assembly 201 and the trim sub-assembly 202, or at any other suitable location. Heat spreader plate 290 can be substituted with any of the heat spreader plates depicted in FIGS. 1A, 2, 3, 4, 5, 6, 7, 8 and/or 9.

The lighting device 200 of FIG. 10 is shown with exemplary spring retainer clips which each include first and second spring-loaded arms 222 that are engageable in a corresponding engagement element mounted on a fixture in which the lighting device 200 is positioned. Each pair of first and second spring-loaded arms 222 can be spring biased apart from each other into contact with opposite sides of the corresponding engagement element, creating friction which holds the lighting device 200 in position relative to the fixture, while permitting the lighting device 200 to be moved to different positions relative to the fixture. Alternatively, the first and second spring-loaded arms 222 can be spring biased toward each other into contact with opposite sides of a corresponding engagement element, thereby similarly creating friction which holds the lighting device 200 in position relative to the fixture, while permitting the lighting device 200 to be moved to different positions relative to the fixture. Instead of the spring retainer clips, the lighting device can include any other suitable adjustably holding structure.

The lighting device 200 can be assembled by placing the mixing chamber sub-assembly 203 in an assembly jig, placing the trim sub-assembly 202 in the assembly jig, soldering the light emitting diode board wires 214 to the driver circuit board 205, placing any heat spreader plate and/or spacer elements on or in the trim sub-assembly 202 (and/or attaching spacer elements to the driver sub-assembly 201), placing the driver sub-assembly 201 in the assembly jig, inserting screws 226 through openings provided in the driver sub-assembly 201, through corresponding openings provided in the heat spreader plate 290, through corresponding openings provided in the trim sub-assembly 202, and into corresponding holes provided in the mixing chamber sub-assembly 203 and tightening the screws 226 down. As shown, heat spreader plate is attached to the upper surface of the trim sub-assembly 202, and/or to the lower surface of the driver sub-assembly 201. If desired, screw hole covers 224 can be inserted into the openings in the driver sub-assembly 201 to cover the screws and provide a smooth surface on the driver sub-assembly 201. Instead of the screws, any other connecting elements can be employed, e.g., nut and bolt combinations, spring clips, rivets, adhesive, etc.

Figure 11:
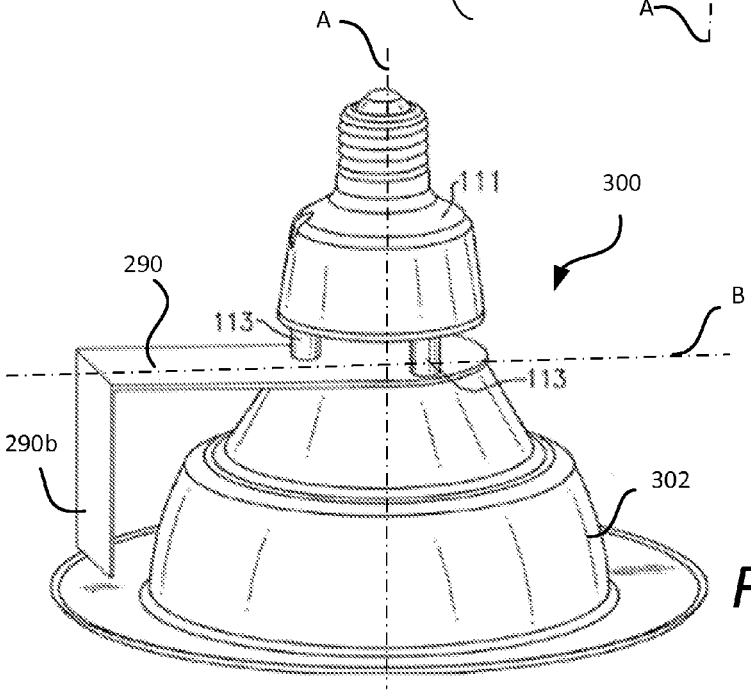
FIG. 11 is a perspective view of an exemplary low-cost lighting device having a heat spreader plate embodiment as disclosed and described herein.

FIG. 11 is a perspective view of an alternative exemplary low-cost lighting device 300 having heat spreader plate 290 in combination with a plurality of LEDs. Lighting device 300 comprises a driver sub-assembly 111, non-metallic trim sub-assembly 302 aligned along principle axis A, and three spacer elements 113 (only two of the three spacer elements 113 are visible in FIG. 11). In one aspect, trim sub-assembly 302 is at least 50% (wt/wt or vol/vol) plastic, or at least 60% plastic, or at least about 70% plastic, or at least about 80% plastic, or at least about 90% plastic. In one aspect, trim sub-assembly 302 is essentially 100% plastic. Heat spreader plate 290 has base generally in-plane with longitudinal axis B and projecting side wall 290*b* projecting generally perpendicular from axis B. If multiple sidewall projections are employed, two or more projections can project in opposed directions relative to the longitudinal axis of the base. Heat spreader plate 290 can be extended in length to thermally couple with a portion of trim sub-assembly 302, for example, a portion exposed to the ambient. Heat spreader plate 290 can be substituted with any of the heat spreader plates depicted in FIGS. 1A, 2, 3, 4, 5, 6, 7, 8 and/or 9.

Figure 12:
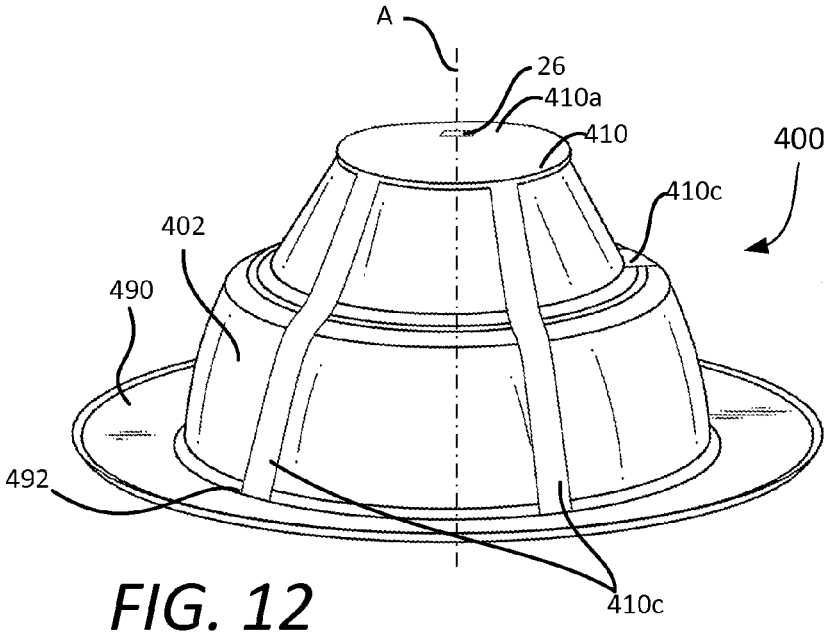
FIG. 12 is a perspective view of a partially assembled exemplary low-cost lighting device having a heat spreader plate embodiment and non-metallic trim, as disclosed and described herein.

FIG. 12 is a perspective view of an alternative exemplary low-cost lighting device 400 having heat spreader plate 410 (similar to that as shown in FIG. 4), having generally annular shaped base with top surface 410*a* (base) and projecting sidewall projections 410*c*, the projecting sidewalls having first and second surfaces contiguous with the base top and bottom surfaces, respectively. Sidewall projections 410*c*, can independently be of any length, preferably a length appropriate for the lighting device, and/or of a length to reach the annular rim 490 of trim sub-assembly 402 of trim. The sidewall portions can be shaped with angular bends or arcuate bends commensurate with the shape of the trim. The sidewall portions can be symmetrically or asymmetrically arranged about the base. The transition from either surface of the base to the sidewall portions can be edge-like or rounded. Heat spreader plate 410 and projections 410*c* can be formed, for example, by progressive die shaping, or by stamping one or more sheets of material (or segments of differing size or extent) to form a blank and shaping the blank (e.g., bending) to arrive and the desired shape. Plastic molding processes can be used to configure trim sub-assembly 402 with plate 410 and sidewall projections 410*c*., e.g., by co-molding or overmolding. Trim sub-assembly 402 can also be assembled to plate 410 and/or projections 410*c*. A plurality of LEDs (not shown), can be accessed via aperture 26 in the bottom surface through the top side of plate 410. In one aspect, trim sub-assembly 402 is at least 50% (wt/wt or vol/vol) plastic, or at least 60% plastic, or at least about 70% plastic, or at least about 80% plastic, or at least about 90% plastic. In one aspect, trim sub-assembly 402 is essentially 100% plastic.

In the configuration shown in FIG. 12, sidewall projections 410*c* function as thermally conductive paths about trim sub-assembly 402 to the ambient. Other arrangements of sidewall projections 410*c* can be used, such as wires, strips, bands, connected dots/islands, "spider-web" arrangement, and the like. The size (including thickness), width, length, shape, material, and conformation of sidewall projections 410*c* may be varied from that shown in FIG. 12. Sidewall projections 410*c* can be configured together with additional thermally conductive elements, either of which can be positioned on either surface of trim sub-assembly 402, or co-molded or overmolded with the sub-assembly. In one aspect, at least a portion of the sidewall projections 410*c* are metal, conductive plastic, or combinations thereof. Sidewall projections 410*c* (or other thermally conductive elements) can alternatively be mechanically attached and/or adhesively bonded to trim sub-assembly 402. Sidewall projections 410*c* (or other thermally conductive elements), can be metal, or a conductive plastic, or a plastic that is metal-electroplated, -sputtered, or -implanted, which can be formed in any pattern on trim sub-assembly 402. In one aspect, sidewall projections 410*c* (or other thermally conductive elements) are configured to provide a thermal path between the heat spreader 410 base plate and outside (or surrounding) ambient air, for example, by thermally coupling (integrally or via assembly, as shown at 492) with annular rim 490 of trim sub-assembly 402, such that the low-cost lighting device meets certain requirements for downlights, for example, downlights used in insulated ceilings. Annular rim 490 of trim sub-assembly 402 can be metal, conductive plastic, metal electroplated plastic, metal sputtered plastic, metal foil coated, or metal implanted plastic. Trim subassembly 402 can be substituted with any of the heat spreader plates depicted in FIGS. 1A, 2, 3, 4, 5, 6, 7, 8 and/or 9.

Figure 13:
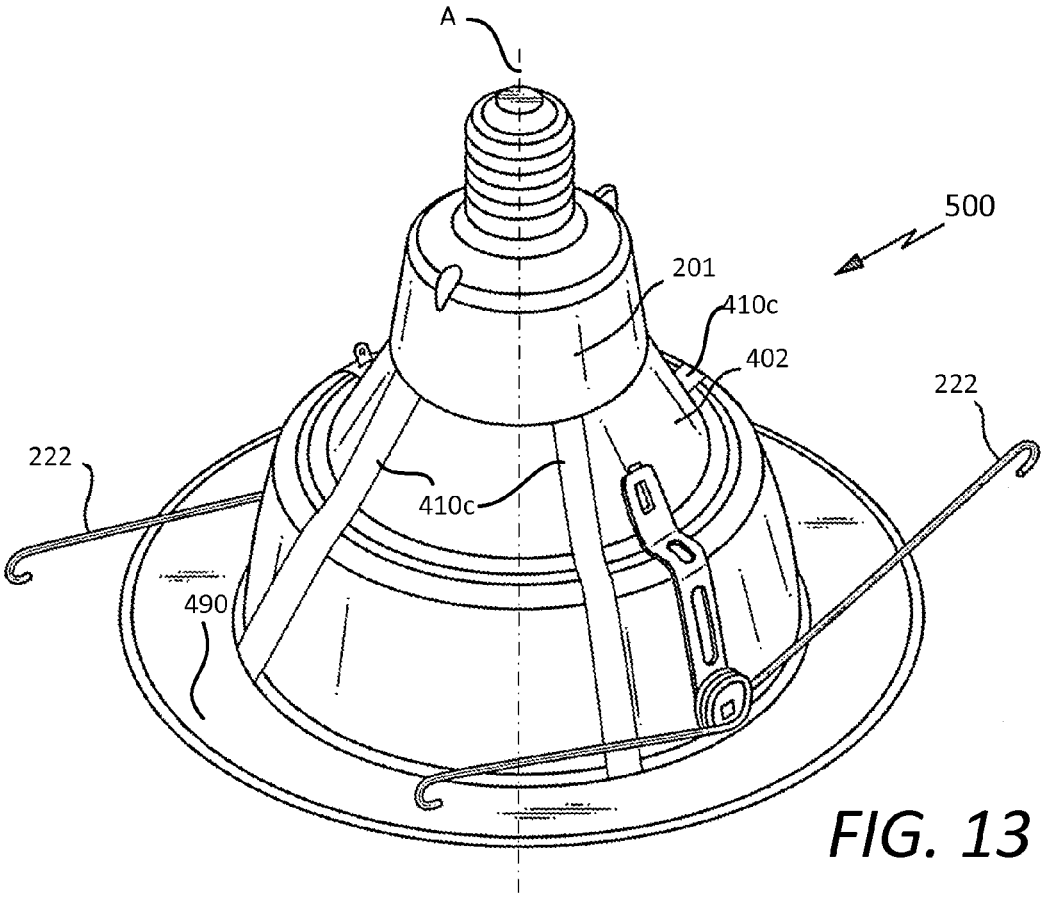
FIG. 13 is a perspective view of an exemplary low-cost lighting device having a heat spreader plate embodiment and non-metallic trim, as disclosed and described herein.

FIG. 13 is a perspective view of an exemplary low-cost lighting device 500, which includes the heat spreader plate 410 of FIG. 12, shown in a further assembled state, comprising a driver sub-assembly 201, a trim sub-assembly 402 aligned along principle axis A, and installation hardware, e.g., first and second spring-loaded arms 222 and associated attachment elements for securing to device). In one aspect, trim sub-assembly 402 is at least 50% (wt/wt or vol/vol) plastic, or at least 60% plastic, or at least about 70% plastic, or at least about 80% plastic, or at least about 90% plastic. In one aspect, trim sub-assembly 402 is essentially 100% plastic. Sidewall projections 410*c* (or other thermally conductive elements) are configured about trim sub-assembly 402 as described above. Spacer elements 113 (as shown and described in FIG. 11) can also be employed in device 500.

The lighting device 200, 300, and 500, and the components thereof, can be assembled in any other suitable way. In one embodiment, as discussed above, the trim sub-assembly is constructed of plastic or plastic alloys. In one aspect, the trim sub-assembly is constructed entirely of plastic or plastic alloys. The plastic, or a portion of the trim thereof, may be thermally conductive plastic, for example, plastic or plastic alloys having a thermal conductivity of about 0.2 W/mK up to about 10 W/mK or more.

Any two or more structural parts of the lighting devices described herein can be integrated. Any structural part of the lighting devices described herein can be provided in two or more parts (which may be held together in any known way, e.g., with adhesive, screws, bolts, rivets, staples, snap-fit, etc.).

It is to be appreciated that size (including thickness), shape, and conformation of heat spreader plates may be varied from the designs illustrated herein within the scope of the present invention. In one embodiment, at least three concentric sidewall portions, preferably including apertures to facilitate air circulation, may be formed by stamping one or more sheets of material (or segments of differing size or extent) to form a blank and shaping the blank (e.g., bending) to arrive and the desired shape.

The present disclosure is applicable to lighting devices of any size or shape capable of incorporating the described heat transfer structure, including flood lights, spot lights, and all other general residential or commercial illumination products. The heat spreader plate elements, non-metallic trim/reflector assembly, and low-cost lighting devices presently disclosed are generally applicable to a variety of existing lighting packages, for example, CR6, LR4, and LR6 downlights, XLamp products XM-L, ML-B, ML-E, MP-L Easy-White, MX-3, MX-6, XP-G, XP-E, XP-C, MC-E, XR-E, XR-C, and XR LED packages manufactured by Cree, Inc.

Furthermore, while certain embodiments of the present disclosure have been illustrated with reference to specific combinations of elements, various other combinations may also be provided without departing from the teachings of the present disclosure. Thus, the present disclosure should not be construed as being limited to the particular exemplary embodiments described herein and illustrated in the Figures, but may also encompass combinations of elements of the various illustrated embodiments and aspects thereof.

We claim:

1. A solid state lighting device comprising:

a plurality of solid state emitters; and a heat spreader plate of thermally conductive material having a base in thermal communication with the plurality of solid state emitters, and at least one sidewall projecting from the base;

wherein the plurality of solid state emitters provides a thermal load not more than about 5 Watts upon application of an operating current and voltage, the heat spreader plate dissipating a portion of the thermal load to an ambient air environment.

2. The solid state lighting device of claim 1, wherein the plurality of solid state emitters provides a total luminosity of about 700 lumens to about 800 lumens at about 110 lumens per Watt to about 170 lumens per Watt, about 2500 K to about 2900 K correlated color temperature, and greater than or equal to 90 color rendering index.

3. The solid state lighting device of claim 1, wherein the plurality of solid state emitters provides a total luminosity of about 750 lumens at about 140 lumens per Watt, about 2700 K correlated color temperature, and greater than or equal to 90 color rendering index.

4. The solid state lighting device of claim 1, wherein the heat spreader plate dissipates substantially all of the thermal load to an ambient air environment.

5. The solid state lighting device of claim 1, further comprising at least one of a substantially non-metallic trim element and substantially non-metallic reflector.

6. The solid state lighting device of claim 5, wherein the thermal conductivity of the trim element and the reflector are less than 1 W/m-K.

7. The solid state lighting device of claim 5, wherein the thermal conductivity of the trim element and the reflector are less than 1 W/m-K, and the thermal conductivity of the heat spreader plate is greater than 10 W/m-K.

8. The solid state lighting device of claim 5, wherein at least a portion of the trim element and/or the reflector are of a thermally conductive plastic.

9. The solid state lighting device of claim 5, further comprising a thermal path between the heat spreader plate, the trim element and/or the reflector, and the ambient, the thermal path comprising metal and/or thermally conductive plastic in thermal communication with the heat spreader plate.

10. The solid state lighting device of claim 5, wherein the ratio of thermal conductivity of the heat spreader plate and the at least one trim element and/or the reflector is between about 10:1 to about 1000:1.

11. The solid state lighting device of claim 1, wherein the lighting device is devoid of graphite heat spreaders and/or thermal gap pads.

12. The solid state lighting device of claim 1, wherein the heat spreader plate is capable of dissipating at least about 2 Watts in an ambient air environment of about 35 degrees Centigrade while maintaining a junction temperature of the solid state emitter at or below about 95 degrees Centigrade.

13. The solid state lighting device of claim 1, wherein the heat spreader plate is sized to fit within a downlight can assembly.

14. The solid state lighting device of claim 1, wherein the least one sidewall projects substantially non-parallel from the longitudinal axis of the base.

15. The solid state lighting device of claim 1, wherein the at least one sidewall projects substantially parallel to the principal axis of the lighting device.

16. The solid state lighting device of claim 1, wherein the base portion and the at least one portion form an L-like shape.

17. The solid state lighting device of claim 1, wherein the plurality of solid state emitters are chip-scale solid state emitters of at least 5 in number.

18. The solid state lighting device of claim 1, wherein the plurality of solid state emitters are chip-scale solid state emitters of at least 20 in number.

19. A solid state lighting device comprising:

a plurality of solid state emitters, the plurality of solid state emitters provides a total luminosity of about 700 lumens to about 800 lumens at about 110 lumens per Watt to about 170 lumens per Watt, about 2500 K to about 2900 K correlated color temperature, and greater than or equal to 90 color rendering index, and generating a thermal load not more than about 5 Watts;

a heat spreader plate of thermally conductive material having a base in thermal communication with the plurality of solid state emitters, and at least one sidewall projecting in a direction non-parallel from the longitudinal axis of the base; and wherein the plurality of solid state emitters generates a total thermal load of less than about 5 Watts upon application of an operating current and voltage, the heat spreader plate dissipating a portion of the thermal load to an ambient air environment.

20. The solid state lighting device of claim 19, wherein the plurality of solid state emitters provides a total luminosity of about 750 lumens at about 140 lumens per Watt, about 2700 K correlated color temperature, and greater than or equal to 90 color rendering index.

21. The solid state lighting device of claim 19, further comprising at least one of a trim element and a reflector, the trim element and/or reflector having a thermal conductivity less than the heat spreader plate.

22. The solid state lighting device of claim 19, wherein the base portion and the at least one sidewall portion form an L-like shape adapted to receive at least a portion of the reflector.

23. The solid state lighting device of claim 19, wherein the at least one sidewall portion comprises a plurality of spatially segregated sidewall portions.

24. The solid state lighting device of claim 19, wherein the base portion comprises at least one aperture configured to receive at least one electrical conductor operatively connected to the at least one solid state emitter.

25. The solid state lighting device of claim 19, the heat spreader plate dissipating substantially all of the thermal load to an ambient air environment.

26. The solid state lighting device of claim 21, wherein the at least one of a trim element and a reflector are of substantially plastic construction.

27. The solid state lighting device of claim 21, wherein the trim element and the reflector are configured for snap-together assembly with each other.

28. The solid state lighting device of claim 21, wherein at least a portion of the trim element and/or the reflector are of a thermally conductive plastic.

29. The solid state lighting device of claim 28, further comprising a thermal path between the heat spreader plate and/or the trim element and/or the reflector and the ambient, the thermal path comprising metal and/or thermally conductive plastic in thermal communication with the heat spreader plate.

30. A solid state lighting device comprising:

a plurality of chip-scale solid state emitters; the plurality of chip-scale solid state emitters providing a total luminosity of about 700 lumens to about 800 lumens at about 110 lumens per Watt to about 170 lumens per Watt, and generating a thermal load not more than about 5 Watts; and a device-scale heat spreader plate in thermal communication with the plurality of chip-scale solid state emitters, the device-scale heat spreader having a base and at least one sidewall portion projecting substantially non-parallel from the longitudinal axis of the base, the heat spreader plate dissipating at least a portion of the thermal load to an ambient air environment, the device scale heat spreader plate having a thermal conductivity of at least 10 W/m-K.

31. The solid state lighting device of claim 30, wherein the plurality of chip-scale solid state emitters provides a total luminosity of about 750 lumens at about 140 lumens per Watt.

32. The solid state lighting device of claim 30, wherein chip-scale solid state emitters provides about 2500 K to about 2900 K correlated color temperature, and greater than or equal to 90 color rendering index.

33. The solid state lighting device of claim 30, further comprising at least one of a trim element and a reflector, the trim element and/or reflector having a thermal conductivity less than 1 W/m-K.

34. The solid state lighting device of claim 30, wherein at least one of the outward projecting sidewall portions is in a direction non-parallel to the longitudinal axis of the base.

35. The solid state lighting device of claim 30, further comprising a dielectric layer and at least one electrical trace deposited on a metallic sheet providing integral circuitry to the heat spreader plate.

36. The solid state lighting device of claim 30, wherein at least a portion of the heat spreader plate structurally support a lens and/or reflector and/or fixture associated with a solid state lighting device.

37. The solid state lighting device of claim 30, further comprising a housing coupled to at least a portion of the heat spreader plate, the housing configured to contain at least one of ballast, circuit driver, PCB board, a screw base connector, an electrical plug connector, and at least one terminal adapted to compressively retain an electrical conductor or current source element.

38. The solid state lighting device of claim 30, wherein the heat spreader plate dissipates substantially all of the thermal load to the ambient air environment.

* * * * *